US009244424B1

(12) United States Patent
Sakaguchi et al.

(10) Patent No.: US 9,244,424 B1
(45) Date of Patent: Jan. 26, 2016

(54) CLEANING BLADE, IMAGE FORMING APPARATUS AND PROCESS CARTRIDGE

(71) Applicants: Hiromi Sakaguchi, Kanagawa (JP); Shinji Nohsho, Tokyo (JP); Yohta Sakon, Kanagawa (JP); Masahiro Ohmori, Kanagawa (JP); Yuka Aoyama, Kanagawa (JP); Masanobu Gondoh, Kanagawa (JP); Shohei Gohda, Ishikawa (JP); Kaori Toyama, Kanagawa (JP)

(72) Inventors: Hiromi Sakaguchi, Kanagawa (JP); Shinji Nohsho, Tokyo (JP); Yohta Sakon, Kanagawa (JP); Masahiro Ohmori, Kanagawa (JP); Yuka Aoyama, Kanagawa (JP); Masanobu Gondoh, Kanagawa (JP); Shohei Gohda, Ishikawa (JP); Kaori Toyama, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/742,193

(22) Filed: Jun. 17, 2015

(30) Foreign Application Priority Data

Jul. 4, 2014 (JP) ..... 2014-138502

(51) Int. Cl.
*G03G 21/00* (2006.01)

(52) U.S. Cl.
CPC ..... *G03G 21/0017* (2013.01)

(58) Field of Classification Search
CPC ..... G03G 21/017
USPC ..... 399/350
See application file for complete search history.

(56) References Cited

U.S. PATENT DOCUMENTS

2014/0178103 A1 6/2014 Gohda et al.
2014/0341629 A1* 11/2014 Watanabe et al. .. G03G 21/0017 399/350

FOREIGN PATENT DOCUMENTS

JP 2010-152295 7/2010

* cited by examiner

*Primary Examiner* — Quana M Grainger
(74) *Attorney, Agent, or Firm* — Cooper & Dunham LLP

(57) ABSTRACT

A cleaning blade cleaning the surface of an object includes a rigid holder; and a strip-shaped elastic body fixed on the holder, including a tip ridgeline to contact the surface of the object. The cleaning blade includes a part having a Martens hardness of from 0.9 to 5.0 N/mm$^2$ at a depth of 20 μm from an undersurface of the blade including the ridgeline, 0.3 to 0.8 N/mm$^2$ at a depth of 40 μm therefrom, and the Martens hardness at a depth of 20 μm therefrom larger than that at a depth of 40 μm therefrom by 0.6 N/mm$^2$.

9 Claims, 5 Drawing Sheets

CLEANING BLADE, IMAGE FORMING APPARATUS AND PROCESS CARTRIDGE

CROSS-REFERENCE TO RELATED APPLICATIONS

This patent application is based on and claims priority pursuant to 35 U.S.C. §119 to Japanese Patent Application No. 2014-138502, filed on Jul. 4, 2014, in the Japan Patent Office, the entire disclosure of which is hereby incorporated by reference herein.

BACKGROUND

1. Technical Field

The present invention relates to a cleaning blade, and an image forming apparatus and a process cartridge using the cleaning blade.

2. Description of the Related Art

An electrophotographic image forming apparatus typically forms an image by the following process. Namely, first, an image bearer such as a photoconductor uniformly charged by a charger is scanned with light to form an electrostatic latent image thereon, and the electrostatic latent image is developed by an image developer. Next, a toner image formed on the image bearer by the development is directly or through an intermediate transferer on a recording sheet. An untransferred toner adhering to the surface of the image bearer is removed by a cleaning blade.

A cleaning blade using a strip-shaped elastic body is well known because of having simple constitution and good cleanability. The elastic blade is formed of an elastic body such as polyurethane rubbers. A base end of the elastic blade is fixed on a rigid holder and a tip ridgeline thereof is pressed against a circumferential surface of an image bearer such as photoreceptors to dam and scrape off a toner remaining on the image bearer.

However, when a spherical toner is used to produce high-quality images, it enters a slight gap between the cleaning blade formed of only a conventional rubber and the photoreceptor drum, and soon scrapes off from the gap, occasionally resulting in poor cleaning.

A contact pressure between the image bearer and the cleaning blade needs increasing to prevent the toner from scraping from the gap. However, when the contact pressure is increased, a friction between an image bearer 3 and a cleaning blade 62 in FIG. 5A increases, the cleaning blade 62 is drawn in a travel direction of the image bearer, and a tip ridgeline 62*c* of the cleaning blade 62 turns over. The cleaning blade 62 turned over occasionally makes noises when restored to its original state, resisting turning over. Further, when the cleaning continues while the tip ridgeline 62*c* of the cleaning blade 62 is turned over, a local abrasion is made a few μm from the tip ridgeline 62*c* of an edge surface 62*a* of the cleaning blade 62 as shown in FIG. 5B. When the cleaning continues further, the local abrasion becomes large and finally the tip ridgeline 62*c* is chipped as shown in FIG. 5C. When the tip ridgeline 62*c* lacks, a toner cannot normally be removed, resulting in poor cleaning.

In order to prevent the tip ridgeline 62*c* of the cleaning blade contacting the surface of the photoconductor drum from turning over, trials of hardening the edge to be difficult to deform are made. For example, a surface layer including an UV curing resin is formed on the tip ridgeline 62*c* of the cleaning blade or the elastic member such that the tip ridgeline 62*c* is hardened to prevent the tip ridgeline 62*c* from turning over.

Japanese published unexamined application No. JP-2010-152295-A discloses a cleaning blade which is an elastic blade formed of a urethane rubber or the like and a surface layer harder than the elastic blade, which covers a tip ridgeline part thereof contacting an image bearer. This claims the blade removes a downsized and spheroidized polymerization toner well, and prevents the blade from turning over the tip ridgeline, making a noise and being abraded to have stable cleanability for long periods.

However, the cleaning blade disclosed in Japanese published unexamined application No. JP-2010-152295-A has lower followability to fine oscillation of the image bearer to cause poor cleaning due to its tip ridgeline having high hardness. Recently, needs for image forming apparatus with electrophotographic process at higher speed have been increasing. The higher image forming speed, not less than a linear speed of 60 mm/sec, causes an axis of the image bearer rotating at high speed to finely oscillate. Therefore, the cleaning blade disclosed in Japanese published unexamined application No. JP-2010-152295-A is not sufficiently suitable for the higher speed image forming apparatus.

When the blade is hardened against turn over and abrasion, the blade deteriorates in followability. When softened to increase followability, the blade tends to turn over and easily abrade. This is a trade-off relation, and a cleaning blade preventing turn over and abrasion and having followability is required, particularly in a high-speed image forming apparatus rotating a photoreceptor drum at a high speed.

SUMMARY

Accordingly, one object of the present invention is to provide a cleaning blade having high followability and preventing its tip ridgeline from turning over, itself from making a noise and being abraded to have stable cleanability even in high speed printing.

Another object of the present invention is to provide an image forming apparatus using the cleaning blade.

A further object of the present invention is to provide a process cartridge using the cleaning blade.

These objects and other objects of the present invention, either individually or collectively, have been satisfied by the discovery of a cleaning blade cleaning the surface of an object, including a rigid holder; and a strip-shaped elastic body fixed on the holder, including a tip ridgeline contact the surface of the object, wherein the cleaning blade includes a part having a Martens hardness of from 0.9 to 5.0 N/mm$^2$ at a depth of 20 μm from an undersurface of the blade including the ridgeline, 0.3 to 0.8 N/mm$^2$ at a depth of 40 μm therefrom, and the Martens hardness at a depth of 20 μm therefrom larger than that at a depth of 40 μm therefrom by 0.6 N/mm$^2$.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
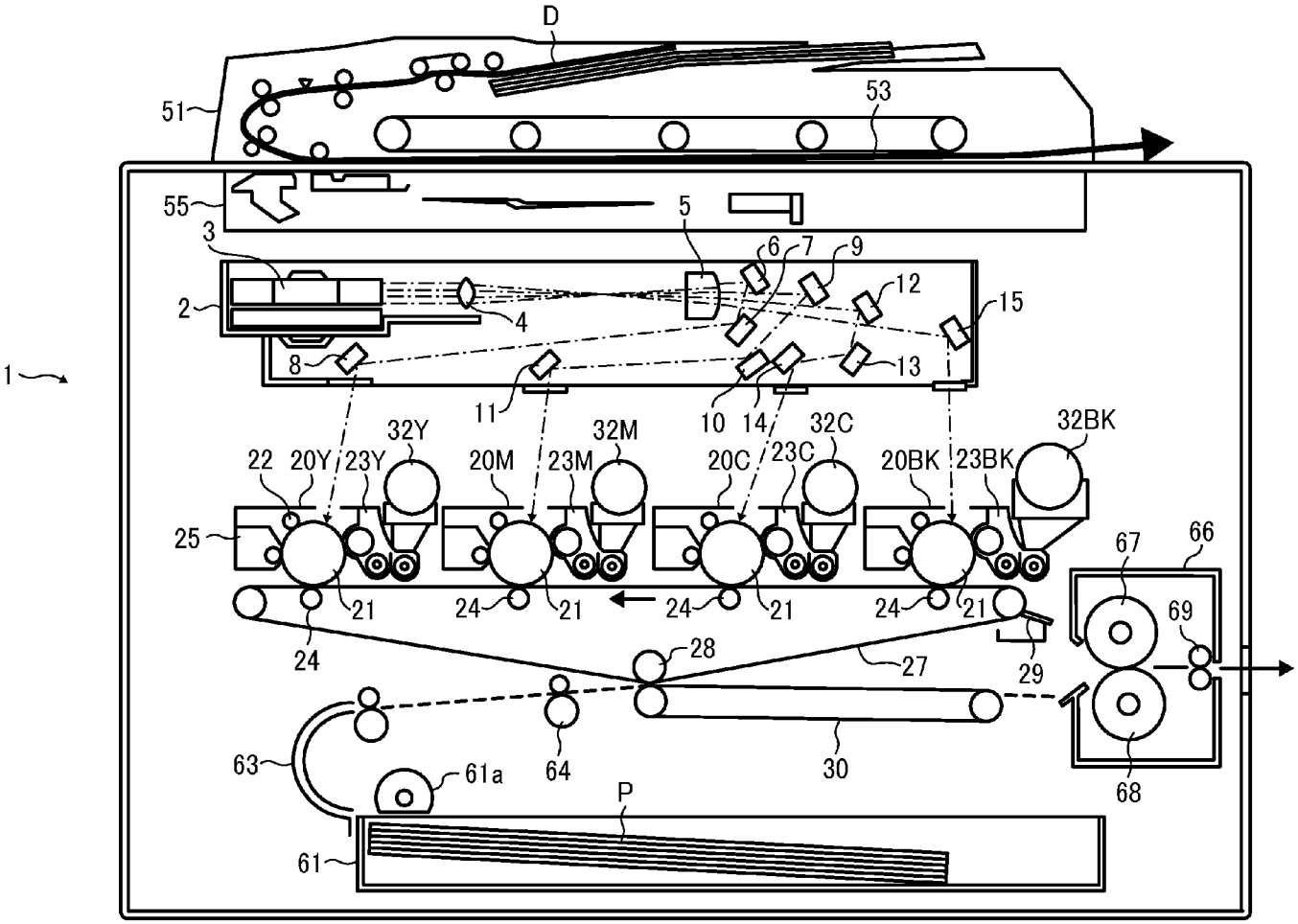
FIG. 1 is a schematic view illustrating an embodiment of the image forming apparatus of the present invention.

The present invention provides a cleaning blade having high followability and preventing its tip ridgeline from turning over, itself from making a noise and being abraded to have stable cleanability even in high speed printing.

More particularly, the present invention relates to a cleaning blade cleaning the surface of an object, including a rigid holder; and a strip-shaped elastic body fixed on the holder, including a tip ridgeline contact the surface of the object, wherein the cleaning blade includes a part having a Martens hardness of from 0.9 to 5.0 N/mm$^2$ at a depth of 20 μm from an undersurface of the blade including the ridgeline, 0.3 to 0.8 N/mm$^2$ at a depth of 40 μm therefrom, and the Martens hardness at a depth of 20 μm therefrom larger than that at a depth of 40 μm therefrom by 0.6 N/mm$^2$.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Next, the cleaning blade of the present invention is explained.

Figure 3:
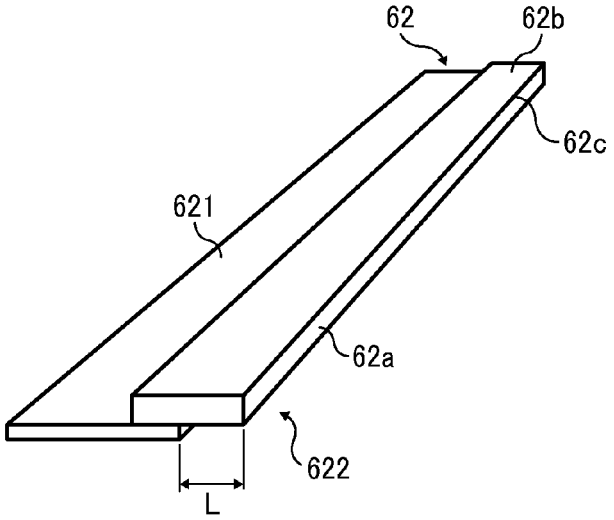
FIG. 3 is a perspective view illustrating an embodiment of the cleaning blade of the present invention.
Figure 4:
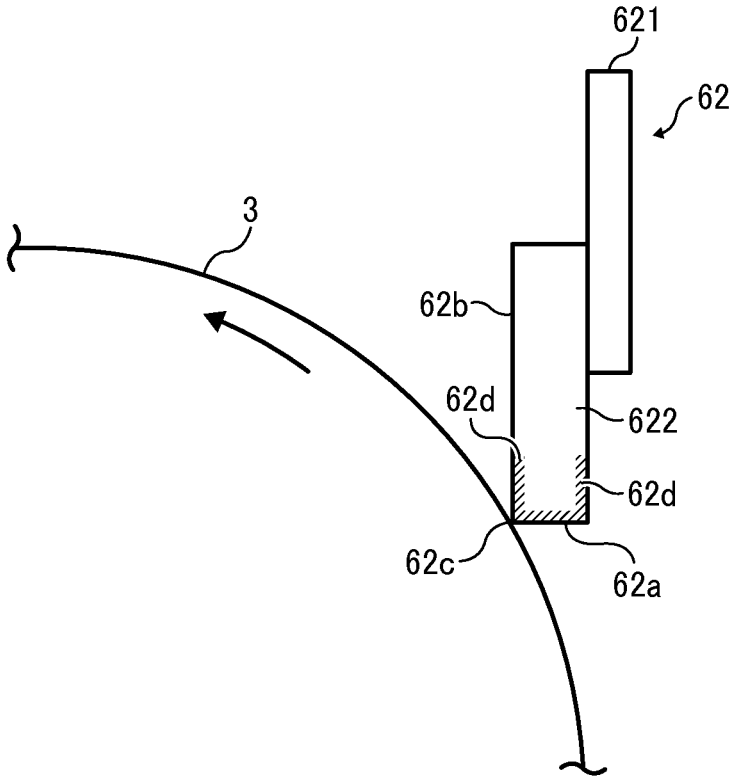
FIG. 4 is an amplified sectional view illustrating the cleaning blade.
Figure 5A:
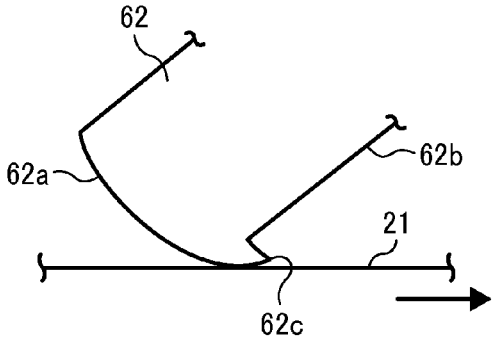
FIGS. 5A to 5C are schematic views for explaining how a cleaning blade is damaged.
Figure 5B:
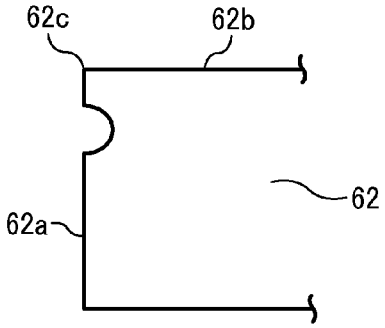
Figure 5C:
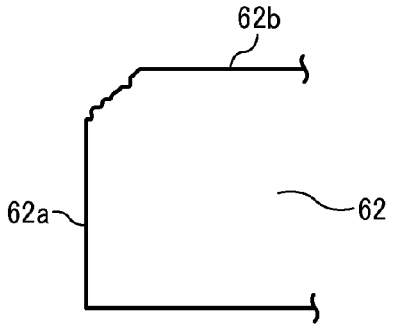

FIG. 3 is a perspective view illustrating an embodiment of the cleaning blade of the present invention. FIG. 4 is an amplified sectional view illustrating the cleaning blade.

A cleaning blade 62 includes a strip-shaped holder 621 which is made of a rigid material such as metals and hard plastics, and a strip-shaped elastic blade 622. The holder 621 may be formed of any materials if it is capable of fixing the elastic blade 622. The elastic blade 622 is preferably a material having high impact resilience coefficient such as polyurethane.

An undersurface 62*b* which is one of two surfaces including a ridgeline contacting an object to be cleaned of the cleaning blade, facing downstream in travel direction of an object to be cleaned, has a Martens hardness of from 0.9 to 5.0 N/mm$^2$ at a depth of 20 μm and 0.3 to 0.8 N/mm$^2$ at a depth of 40 μm from the surface in an arrow direction in FIG. 4, and a part where the Martens hardness at a depth of 20 μm therefrom is larger than that at a depth of 40 μm therefrom by 0.6 N/mm$^2$. This solves a problem of lowering of followability of the cleaning blade having a highly hardened tip ridgeline 62*c*. A part from the surface of the undersurface 62*b* including the ridgeline contacting the object to be cleaned of the cleaning blade having a Martens hardness of from 0.9 to 5.0 N/mm$^2$ at a depth of 20 μm, 0.3 to 0.8 N/mm$^2$ at a depth of 40 μm, and the Martens hardness at a depth of 20 μm is larger than that at a depth of 40 μm by 0.6 N/mm$^2$ preferably has a Martens hardness of from 0.3 to 0.8 N/mm$^2$ at a depth of 30 μm to improve followability further. The part where the Martens hardness has a difference between the inside and the surface is preferably located on the surface from the tip ridgeline 62*c* in a length of L/2. The elastic blade 622 fixed on the rigid holder 621 has a projection from the holder and L is a length of the projection from the holder 621 to the tip ridgeline 62*c* and 4 mm or longer. When the elastic blade has a hard surface toward the holder from L/2, the elastic blade occasionally does not have sufficient followability. When L is less than 4 mm (too short), it is difficult to make a difference of hardness across L/2, and the elastic blade occasionally does not have sufficient followability. L is preferably not longer than 20 mm, and more preferably not longer than 10 mm. When longer than 20 mm, the elastic blade tends to turn over.

The part having the above Martens hardness is preferably in a range not less than 1 mm from the tip ridgeline 62*c* of the undersurface of the blade.

A difference of the hardness between the surface and the inside of the elastic blade increases followability thereof and prevents the blade from turning over and abrading.

Marten's hardness is measured as follows. Namely, a microscopic hardness meter HM-2000 from Fischer Instruments is used, in which Vickers indenter is pushed into an object at 1.0 mN for 10 sec, held for 5 sec, and drawn at 1.0 mN for 10 sec.

The strip-shaped elastic blade is cut in round slices in a vertical direction, and the insides of 20, 30 and 40 μm from the surface including the ridgeline were measured.

The difference of the hardness between the surface and the inside of the elastic blade is obtained by impregnating the elastic blade 622 such as polyurethane with a curable resin monomer or forming a surface layer thereon to be highly hardened. When the blade is impregnated, curable resin monomers, polymerization initiators, curing methods, concentration of solid contents, concentration of the polymerization initiators in an impregnation liquid, impregnation time vary depth of a hardened point. In the present invention, in order to realize high followability of the cleaning blade, the above conditions are studied to harden only an extreme surface near the ridgeline of the cleaning blade. The elastic blade is preferably formed of at least a polyurethane rubber and an acrylic curable resin. Specifically, the acrylic curable resin is cured with an UV light using a radical polymerization initiator. Typically, the curable resins include thermosetting resins. All the parts impregnated therewith are cured and it is difficult to harden only the extreme surface. In addition, the radical polymerization initiator preferably has a shorter absorption wavelength, and an UV irradiation lamp is preferably a high-pressure mercury lamp having an illuminance peak at shorter wavelength side. The absorption wavelength of the radical polymerization initiator and the illuminance peak of the UV irradiation lamp are adapted such that UV light is efficiently absorbed at the surface of the blade and the blade is not hardened inside. Therefore, only the extreme surface is hardened. A metal halide lamp irradiating UV light having an illuminance peak at longer absorption wavelength scatters UV light less. Therefore, UV light easily reaches inside, resulting in difficulty of making difference of hardness. In addition, the polymerization initiator preferably has a concentration not less than 10% by weight based on total weight of the acrylic monomers. Therefore, UV light is absorbed by the polymerization initiator at the surface to prevent the inside from hardening. More preferably not greater than 50% by weight. When greater than that, hardening tends to be impaired. A combination of these conditions easily obtains hardness profile of the present invention.

Figure 6:
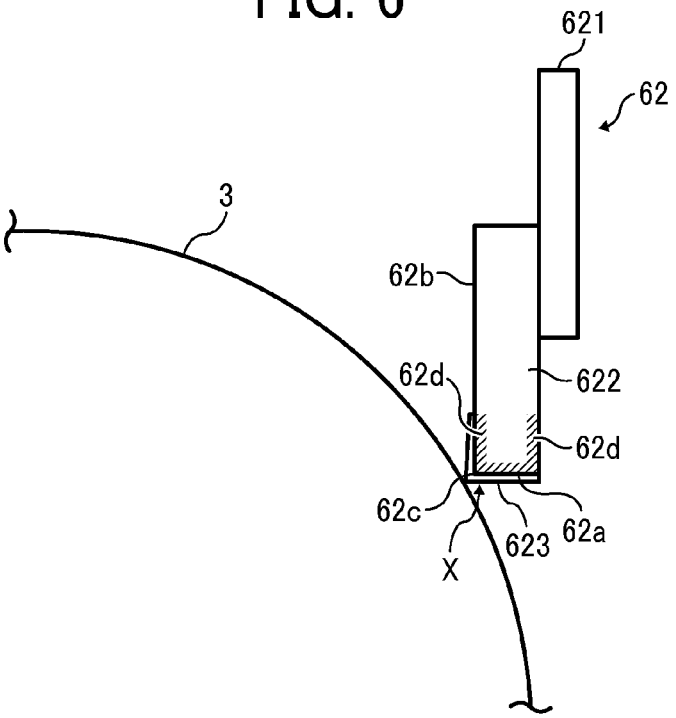
FIG. 6 is an amplified sectional view illustrating a cleaning blade including an impregnated part and surface layer.

Further, as shown in FIG. 6, an acrylic curable resin is spray-coated to form a thin layer 623 on the extreme surface hardened alone by impregnation of the elastic blade to have higher cleanability.

The thin layer preferably has a thickness of from 1 to 5 μm.

An edge surface 62*a* which is one of two surfaces including a ridgeline contacting an object to be cleaned of the cleaning blade, facing upstream in travel direction of an object to be cleaned is not specified in hardness profile as the undersurface 62*b*, but preferably impregnated as the undersurface 62*b* is, and coated with acrylic curable resin The elastic blade 622 is preferably formed of, but is not limited to, polyurethane rubber, and preferably has a Martens hardness not greater than 0.8 $N/mm^2$. Polyurethane rubber more preferably has a Martens hardness of from 0.3 to 0.8 $N/mm^2$.

The UV curing resins are preferably used as the curable resin monomers.

Typical UV curing resins such as modified acrylate can be used, but the followings are preferably used to fully exert cleanability. Namely, when the elastic blade is impregnated, a (meth)acrylate compound having a tricyclodecane structure such as tricyclodecane methanol di(meth)acrylate is preferably used.

Fluorine acrylic monomers are preferably used because of decreasing roughness of the coated surface and levelling the surface.

Various marketed polymerization initiators can be used, e.g., radical polymerization initiators such as Irgacure 651 and 184 having good reactivity from BASF are preferably used. A polymerization initiator having photobleachability such as Irgacure 851 from BASF is not preferably used because of hardening inside. A high-pressure mercury lamp is preferably used to irradiate UV light. The content of the polymerization initiator is preferably not less than 10% by weight based on total weight of the curable monomers. The impregnation time is preferably not longer than a few minutes although depending on the formulation of the coating liquid. When longer than 10 min, it is difficult to harden only the extreme surface.

When a surface layer is formed on the surface of the elastic blade by spray coating of a coating liquid including UV curing resin monomers, (meth)acrylate compounds having a functional group equivalent molecular weight not greater than 350 and 3 to 6 functional groups such as pentaerythritoltriacrylate and dipentaerythritolhexaacrylate are preferably used. When the elastic blade 622 is impregnated by dip coating, (meth)acrylate compounds having a tricyclodecane structure such as tricyclodecane methanol dimethacrylate are preferably used. These acrylates very effectively increase hardness of the elastic blade.

In the coating liquid in spraying and dipping, a polymerization initiator, a polymerization inhibitor, a diluted solvent, etc. besides the hardening resin monomers may be mixed. These are not particularly limited, and marketed products can be used.

Next, the image forming apparatus and the process cartridge of the present invention are explained.

The image forming apparatus of the present invention includes an image bearer and a cleaning member contacting the surface of the image bearer to remove unnecessary adherents adhering thereto, and finally transfer an image formed on the image bearer onto a recording medium. The cleaning member is the cleaning blade of the present invention.

The process cartridge detachable from image forming apparatus of the present invention includes an image bearer and a cleaning member contacting the surface of the image bearer to remove unnecessary adherents adhering thereto. The cleaning member is the cleaning blade of the present invention.

FIG. 1 is a schematic view illustrating an embodiment of the image forming apparatus of the present invention.

As illustrated in FIG. 1, an image forming apparatus (full-color copier) 1 includes an imaging area forming a toner image. The imaging area includes an irradiating (writing) unit 2 emitting a laser beam based on image information. The image forming apparatus further process cartridges 20Y, 20M, 20C and 20BK for yellow, magenta, cyan and black, developing units 23Y, 23M, 23C and 23BK, toner supply units 32Y, 32M, 32C and 32BK, etc.

Each of the process cartridges 20Y, 20M, 20C and 20BK includes a photoconductive drum 21 as an image bearer, a charger 22 charging the surface of the photoconductive drum 21 and a cleaning unit 25 collecting an untransferred toner on the photoconductive drum 21. The irradiating (writing) unit 2 optically scans the uniformly-charged surface of each of the process cartridges 20Y, 20M, 20C and 20BK to form an electrostatic latent image on the surface of each of the photoconductive drums 21. Each of the developing units 23Y, 23M, 23C and 23BK develops the electrostatic latent image on each of the photoconductive drums 21. Each of the toner supply units 32Y, 32M, 32C and 32BK supplies each color toner to each of the developing units 23Y, 23M, 23C and 23BK.

Below the imaging area, an intermediate transfer belt 27 on which plural toner images are overlappingly transferred is provided. A transfer bias roller 24 transferring a toner image formed on the photoconductive drum 21 onto to the intermediate transfer belt 27 is provided opposite to the photoconductive drum 21 through the intermediate transfer belt 27. Further, the image forming apparatus 1 includes a second transfer bias roller 28 transferring a toner image on the intermediate transfer belt 27 onto a recording medium P and an intermediate transfer belt cleaning unit 29 collecting an untransferred toner on the intermediate transfer belt 27. Further, the image forming apparatus 1 includes a paper feed unit 61 containing recording media P such a transfer paper, a transfer belt 30 transferring the recoding medium P on which a 4-color toner image is transferred, and a fixing unit 66 fixing an unfixed image on the recoding medium P.

Above the image forming apparatus, a document reader 55 reading image information on a document D and a document feeder 51 feeding the document D to the document reader 55 are provided.

Hereafter, typical color image formation in the image forming apparatus is explained.

First, the document D placed on a document tray of the document feeder 51 is transported in a direction shown by an arrow F in FIG. 1 with transport rollers, and placed on a contact glass 53 of the document reader 55 to optically read image information of the document D by the document reader 55.

Specifically, the document reader 55 emits light, generated with a light source (not illustrated), to an image on the document D placed on a contact glass 53. Light reflected from the document D is focused onto a color sensor (not illustrated) via mirrors and lenses. The color sensor reads color image information of the document D as RGB (i.e., red, green, and blue) information, and then converts RGB information to electric signals. Based on the electric signals for RGB information, an image processor (not illustrated) conducts various processes such as color converting process, color correction process, and spatial frequency correction process to obtain color image information of yellow, magenta, cyan, and black.

The color image information of yellow, magenta, cyan, and black are then transmitted to the irradiating unit 2. The irradiating unit 2 emits a laser beam corresponding to the color image information of yellow, magenta, cyan, and black, to the respective photoconductive drum 21 in the process cartridges 20Y, 20M, 20C and 20BK.

The photoconductive drum 21 is rotated in a clockwise direction in FIG. 1. The charger 22 uniformly charges the surface of the photoconductive drum 21 to form a charge potential about −700 V on the photoconductive drum 21.

When the charged surface of photoconductive drum 21 comes to an irradiation position, the irradiating unit 2 emits a laser beam corresponding to each color of yellow, magenta, cyan, and black. As illustrated in FIG. 1, the laser beam reflected at a polygon mirror 3 passes lenses 4 and 5, and then follows a separate light path for each color of yellow, magenta, cyan, and black (irradiating process).

A laser beam for yellow component, reflected on mirrors 6 to 8, irradiates the surface of the photoconductive drum 21 in the process cartridge 20Y as illustrated in FIG. 1. Such laser beam for yellow component is scanned in a main scanning direction of the photoconductive drum 21 with a rotation of the polygon mirror 3, rotating at a high speed. With such laser beam scanning, an electrostatic latent image for yellow component is formed on the photoconductive drum 21.

In a similar way, a laser beam for magenta component, reflected on mirrors 9 to 11, irradiates the surface of the photoconductive drum 21 in the process cartridge 20M as illustrated in FIG. 1, and an electrostatic latent image for magenta component is formed on the photoconductive drum 21. In a similar way, a laser beam for cyan component, reflected on mirrors 12 to 14, irradiates a surface of the photoconductive drum 21 in the process cartridge 20C as illustrated in FIG. 1, and an electrostatic latent image for cyan component is formed on the photoconductive drum 21. In a similar way, a laser beam for black component reflected on a mirror 15 irradiates a surface of the photoconductive drum 21 in the process cartridge 20BK as illustrated in FIG. 1, and an electrostatic latent image for black is formed on the photoconductive drum 21.

Then, each of the electrostatic latent images on the respective photoconductive drum 21 comes to a position facing each of the developing units 23Y, 23M, 23C, and 23BK. Each of the developing units 23Y, 23M, 23C, and 23BK supplies respective color toner (i.e., yellow, magenta, cyan, and black) to the respective photoconductive drum 21 to develop respective toner image on the respective photoconductive drum 21 (developing process).

After such developing process, the photoconductive drum 21 comes to a position facing the intermediate transfer belt 27. As illustrated in FIG. 1, four transfer bias rollers 24, provided at inner face of the intermediate transfer belt 27, face the respective photoconductive drum 21 via the intermediate transfer belt 27. Such four transfer bias rollers 24 are used to transfer toner images on the respective photoconductive drum 21 to the intermediate transfer belt 27 by superimposing toner images on the intermediate transfer belt 27 (first transfer process).

Then, the photoconductive drum 21 comes to a position facing the cleaning unit 25. The cleaning unit 25 recovers toners remained on the photoconductive drum 21 after developing process (cleaning process). Then, a discharger (not illustrated) discharges the photoconductive drum 21 to prepare the photoconductive drum 21 for a next image forming operation on the photoconductive drum 21.

The intermediate transfer belt 27 having toner images thereon travels in a direction shown by an arrow L in FIG. 1, and comes to a position of the second transfer bias roller 28. At the second transfer bias roller 28, the toner images are transferred from the intermediate transfer belt 27 to the recording medium P. Further, an image patch pattern, to be described later, is formed on the intermediate transfer belt 27 in a similar image forming process, wherein the image patch pattern is used for adjusting image forming condition or for correcting a displacement of color images. Then, the intermediate transfer belt 27 comes to a position facing the belt cleaning unit 29, which is used to recover toners remained on the intermediate transfer belt 27, by which a transfer process for intermediate transfer belt 27 is completed.

During such image forming process, the recording medium P is transported to the position of the second transfer bias roller 28 from the paper feed unit 61 via a transport guide 63 and a registration roller 64.

Specifically, the recording medium P in the paper feed unit 61 is fed to the transport guide 63, and further fed to the registration roller 64. Such registration roller 64 feeds the recording medium P to the position of the second transfer bias roller 28 by synchronizing a feed timing with toner-image formation timing on the intermediate transfer belt 27.

Then, the recording medium P having the toner images thereon is transported to the fixing unit 66 by the transport belt 30. The fixing unit 66 includes a heat roller 67 and a pressure roller 68 as illustrated in FIG. 1. The fixing unit 66 fixes the toner images on the recording medium P at a fixing nip between the heat roller 67 and the pressure roller 68. After fixing the toner images on the recording medium P, the recording medium P is ejected from the image forming apparatus 1 by an ejection roller 69, by which an image forming process for one cycle is completed.

Figure 2:
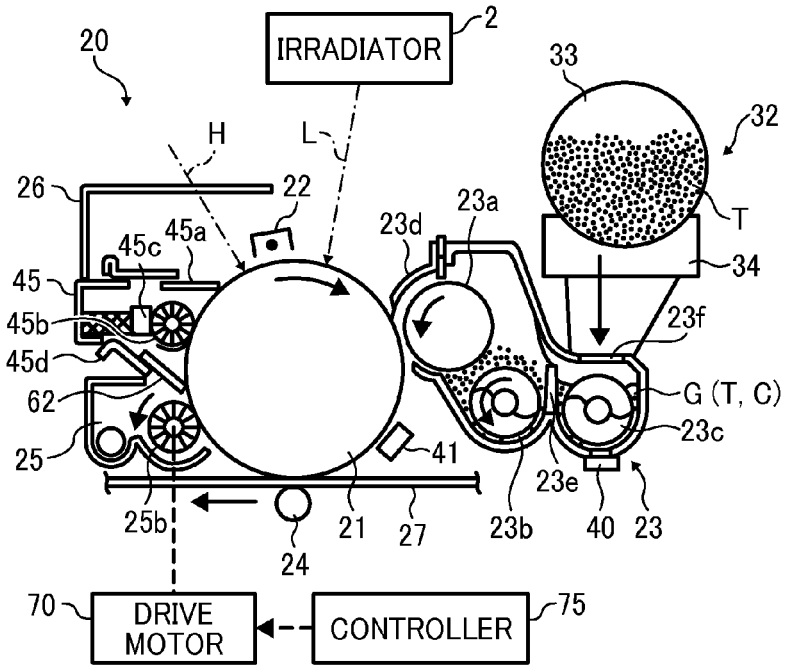
FIG. 2 is a sectional view illustrating an imaging area of the image forming apparatus in FIG. 1.

FIG. 2 is a sectional view illustrating an imaging area of the image forming apparatus in FIG. 1.

The image forming apparatus 1 includes four image forming sections for image forming process. Because the four image forming sections have a similar configuration one to another except a color of toner T, reference characters of Y, M, C, and K for process cartridges, developing units, and toner supply units or other parts are omitted from FIG. 2.

As illustrated in FIG. 2, the process cartridge 20 includes the photoconductive drum 21 as an image bearer, the charger 22, the cleaning unit 25 and a lubricant supplier 45 in a case 26. The process cartridge is exchanged at a predetermined cycle from the image forming apparatus 1. In a similar way, the developing unit 23 is exchanged at a predetermined cycle from the image forming apparatus 1.

(Image Bearer)

The photoconductive drum 21 as an image bearer is typically a negatively-chargeable organic photoconductor. The photoconductor may have a single-layered or multi-layered photosensitive layer. The photoconductor may have an intermediate layer between its substrate and photosensitive layer, and a surface layer on its outermost surface. The photoconductor of the present invention preferably has a surface layer including an acrylic cured resin. The surface layer may include a charge transport material and a particulate metal oxide besides the acrylic cured resin. The acrylic cured resin is obtained by curing a marketed acrylic monomer with UV light. In the present invention, the photoconductive drum 21 rotates at a high linear speed not less than 600 mm/sec for high-speed printing.

(Charger)

A corona wire is extended at the center of a U-shaped metal plate in the charger 22. A predetermined voltage is supplied from an unillustrated power source to the corona wire of the charger 22 so as to uniformly charge the surfaces of the photoconductor drum 21. Further, a metal grid panel may be provided on an opposing surface of the charger 22 that faces the photoconductor drum 21.

(Developing Means)

The developing unit 23 includes a developing roller 23*a* provided opposite the photoconductor 21, a first conveyance screw 23*b* provided opposite the developing roller 23*a*, a second conveyance screw 23*c* provided opposite the first conveyance screw 23*b* with a wall 23*e* interposed therebetween, and a doctor blade 23*d* provided opposite the developing roller 23*a*, away from the first conveyance screw 23*b*. The developing roller 23*a* is constructed of a magnet fixed therewithin to form magnetic poles around a surface of the developing roller 23*a* and a sleeve rotated around the magnet. Multiple magnetic poles are formed on the developing roller 23*a* by the magnet so that the developing roller 23*a* carries a developer G thereon.

The developer G, which in this case is a two-component developer including a carrier C and toner T, is stored in the developing unit 23.

Specifically, the toner T is a spherical toner having a circularity of not less than 0.98. A flow-type particle image analyzer FPIA-2000 manufactured by Sysmex Corporation was used to measure an average circularity of the toner T. Measurements were performed in the following manner. From 0.1 ml to 0.5 ml of surfactant (preferably alkylbenzene sulfonate) serving as a dispersant and from 0.1 g to 0.5 g of a sample, that is, toner, were added to from 100 ml to 150 ml of water, from which impurities were removed in advance. Subsequently, the mixture in which the toner is dispersed was dispersed using an ultrasonic dispersing machine for from 1 to 3 minutes to prepare a sample solution including 3,000 to 10,000 particles/μl. The sample solution thus prepared was then set to the flow-type particle image analyzer FPIA-2000 to measure the shape and particle size distribution of the toner T.

The spherical toner is formed by heating a deformed pulverization toner to be spheric and a polymerization method.

The toner supply unit 32 provided to the image forming apparatus 1 is constructed of a replaceable toner bottle 33 and a toner hopper 34 that holds and rotatably drives the toner bottle 33 as well as supplies a new toner T to the developing unit 23. The toner bottle 33 stores the new toner T of the specified color and has a spiral protrusion on an inner surface thereof.

It is to be noted that the new toner T is appropriately supplied from the toner bottle 33 into the developing unit 23 through a toner supply opening 23*f* in accordance with consumption of the toner T stored in the developing unit 23. A reflective-type photosensor 41 provided opposite the photoconductor 21 and a magnetic sensor 40 provided below the second conveyance screw 23*c* directly or indirectly detect consumption of the toner T in the developing unit 23.

A toner concentration (TC) in the developing unit 23 is controlled to be in a predetermined range. Specifically, the new toner T is appropriately supplied from the toner supply unit 32 to the developing unit 23 via the toner supply opening 23*f* provided to the developing unit 23 such that detected values output from the magnetic sensor 40 and the reflective-type photosensor 41 have the predetermined value.

The lubricant supplier 45 includes a lubricant supply roller 45*b* (lubricant supply brush roller) scraping the photoconductor drum 21 with a brush formed around the roller 45*b* to supply a lubricant to photoconductor drum 21 and a solid lubricant 45*c* contacting the lubricant supply roller 45*b*. The lubricant supplier 45 further includes a compression spring 45*d* biasing the solid lubricant 45*c* to the lubricant supply roller 45*b* and a thinning blade 45*a* (coating blade) contacting the photoconductor drum 21 to thin a lubricant supplied thereon. The lubricant supplier 45 is located at downstream side in the rotational direction of the photoconductor drum 21 relative to the cleaning unit 25 (cleaning blade 62) and upstream side thereof relative to the charger 22.

The lubricant supply roller 45*b* includes a core bar and a brush wound around an outer circumference of the core bar, and rotates anticlockwise while the brush contacts the surface of the photoconductor drum 21 in FIG. 2. Thus, a lubricant is supplied from the solid lubricant 45*c* onto the photoconductor drum 21 through the lubricant supply roller 45*b*.

The lubricant supplier 45 applies a lubricant to the surface of the photoconductor drum 21 and improves releasability (removability) of a toner to prevent poor cleaning.

The solid lubricant 45*c* is preferably zinc stearate. Specific examples of the solid lubricant 45*c* include, besides zinc stearate, stearate groups such as barium stearate, iron stearate, nickel stearate, cobalt stearate, copper stearate, strontium stearate, and calcium stearate; fatty acid groups such as zinc oleate, barium oleate, lead oleate, copper oleate, zinc palmitate, barium palmitate, lead palmitate, and copper palmitate. A caprylic acid group, a linolenic acid group, and a colinolenic acid group can be used as the fatty acid groups. Yet further alternatively, waxes such as candelilla wax, carnauba wax, rice wax, haze wax, jojoba wax, bees wax, and lanoline can be used for the solid lubricant 45*c*. An organic solid lubricant compatible with toner is easily formed from the above-described materials.

The thinning blade 45*a* is a blade-shaped member formed of a rubber material such as polyurethane rubber and contacts the surface of the photoconductor drum 21 at a predetermined angle and a predetermined pressure. The thinning blade 45*a* is located at a downstream side in the rotational direction of the photoconductor drum 21 relative to the cleaning blade 62. The lubricant provided on the photoconductor drum 21 by the lubricant supply roller 45*b* is uniformly thinned thereon by the thinning blade 45*a* in a suitable amount.

When the solid lubricant 45*c* is applied to the surface of the photoconductor drum 21 through the lubricant supply roller 45*b*, the lubricant having the shape of a powder is applied thereto. However, since the lubricant does not exert its lubricity enough in the form of a powder, the thinning blade 45*a* works as a member thinning and uniforming the lubricant. The thinning blade 45*a* forms a film of the lubricant on the photoconductor drum 21 such that the lubricant sufficiently exerts its lubricity.

(Cleaner)

The cleaning unit 25 is formed of the cleaning blade 62 contacting the photoconductor drum 21 to cleaning the surface thereof, the cleaning roller 25*b* (cleaning brush) a brush scraping the photoconductor drum 21 is formed around, etc. The cleaning blade 62 contacts the surface of the photoconductor drum 21 at a predetermined angle and a predetermined pressure. Thus, adhering materials adhering to the photoconductor drum 21 are mechanically scraped off and collected in the cleaning unit 25.

The cleaning blade 62 is the cleaning blade of the present invention.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

| (Preparation of Coating Liquid) | |
|---|---|
| <Coating Liquid 1> | |
| Resin 1: A-DCP from Shin-Nakamura Chemical Co., Ltd. | 100 |
| Resin 2: OPTOOL DAC-HP from DAIKIN INDUSTRIES, Ltd. | 2.5 |
| Polymerization initiator: Irgacure 184 from BASF | 10 |
| Solvent: Cyclohexanone | 400 |
| <Coating Liquid 2> | |
| Resin 1: A-DCP from Shin-Nakamura Chemical Co., Ltd. | 100 |
| Resin 2: OPTOOL DAC-HP from DAIKIN INDUSTRIES, Ltd. | 2.5 |
| Polymerization initiator: Irgacure 184 from BASF | 20 |
| Solvent: Cyclohexanone | 400 |
| <Coating Liquid 3> | |
| Resin 1: A-DCP from Shin-Nakamura Chemical Co., Ltd. | 100 |
| Resin 2: OPTOOL DAC-HP from DAIKIN INDUSTRIES, Ltd. | 2.5 |
| Polymerization initiator: Irgacure 819 from BASF | 20 |
| Solvent: Cyclohexanone | 400 |
| <Coating Liquid 4> | |
| Resin 1: A-DCP from Shin-Nakamura Chemical Co., Ltd. | 100 |
| Resin 2: OPTOOL DAC-HP from DAIKIN INDUSTRIES, Ltd. | 2.5 |
| Polymerization initiator: Irgacure 184 from BASF | 1 |
| Solvent: Cyclohexanone | 400 |

Resin 1 A-DCP from Shin-Nakamura Chemical Co., Ltd. is tricyclodecane methanol dimethacrylate having two functional groups, a functional group equivalent molecular weight of 152 and the following formula.

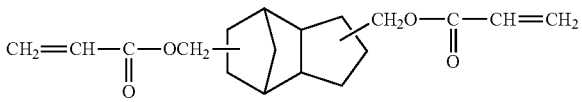

| <Coating Liquid 5> | |
|---|---|
| Resin 1: DPHA from Daicel-cytech Company, Ltd. | 100 |
| Resin 2: OPTOOL DAC-HP from DAIKIN INDUSTRIES, Ltd. | 2.5 |
| Polymerization initiator: Irgacure 184 from BASF | 1.5 |
| Solvent: Cyclohexanone | 900 |

Resin 1 DPHA from Daicel-Cytec Company, Ltd. is pentaerythritol hexaacrylate having six functional groups, a functional group equivalent molecular weight of 96 and the following formula.

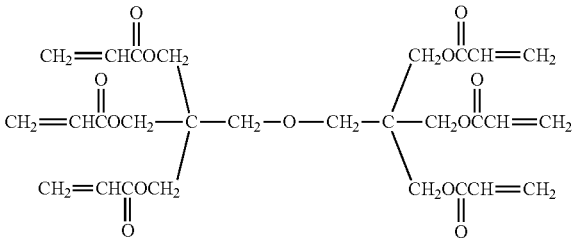

Preparation of Cleaning Blade

Example 1

Preparation of Cleaning Blade 1

A strip-shaped polyurethane rubber having a length of 360 mm, a width of 2 mm and a Martens of from 0.6 to 0.8 N/mm$^2$ was used as the elastic blade.

The Martens hardness of the polyurethane rubber was measured by a microscopic hardness meter HM-2000 from Fischer Instruments is used, in which Vickers indenter is pushed into an object at 1.0 mN for 10 sec, held for 5 sec, and drawn at 1.0 mN for 10 sec.

The polyurethane rubber was fixed on the holder 621 formed of a metal plate with an adhesive so as to have a projected length L of 8 mm from the holder 621 as shown in FIG. 3.

The elastic blade 622 was highly hardened as follows. Namely, first, 3 mm from the ridgeline was dipped in the coating liquid 1 and kept therein for 60 sec to form an impregnated part 62*d* as shown by a shaded area in FIG. 4. Then, a residue was wiped off with a BEMCOT soaked with methyl ethyl ketone from Asahi Kasei Fibers Corp.

Then, in 5 min, the blade was irradiated with UV light by a high-pressure mercury lamp with a light source having an intensity peak at a wavelength of 365 μm in a wavelength range of from 200 to 500 μm. The blade on a conveyor was cured with UV light while passing under the high-pressure mercury lamp at 50 cm/min so as to receive light quantity of 6,000 J/cm$^2$. Then, the blade was dried at 100° C. for 30 min to obtain a [cleaning blade 1].

Example 2

Preparation of Cleaning Blade 2

The procedure for preparation of the cleaning blade 1 in Example 1 was repeated to prepare a [cleaning blade 2] except for replacing the coating liquid 1 with the coating liquid 2.

Example 3

Preparation of Cleaning Blade 3

The procedure for preparation of the cleaning blade 1 in Example 1 was repeated to prepare a [cleaning blade 3] except for changing the time of dipping in the coating liquid from 60 sec to 5 min.

Example 4

Preparation of Cleaning Blade 4

The procedure for preparation of the cleaning blade 3 in Example 3 was repeated to prepare a [cleaning blade 4] except for replacing the coating liquid 1 with the coating liquid 2.

Example 5

Preparation of Cleaning Blade 5

The procedure for preparation of the cleaning blade 2 in Example 2 was repeated to prepare a [cleaning blade 5]

except for replacing the elastic blade with an elastic blade having a Martens hardness of from 0.3 to 0.4 N/mm$^2$.

Example 6

Preparation of Cleaning Blade 6

In Example 1, after the blade was dipped in the coating liquid 1 and a residue was wiped off therefrom, the coating liquid 5 was sprayed on the edge surface 62*a* of the blade in FIG. 6 to form a surface layer 623 thereon. A spray gun SV-91 from SAN-EI TECH Ltd. was used. The spray gun was fixed such that the tip thereof was at the middle of a short axis of the edge surface, the cleaning blade was horizontal in the longitudinal direction and the edge surface 62*a* of the blade in FIG. 6 was vertical. A distance from the tip of the pray gun to the urethane rubber was 60 mm. The coating liquid discharge speed was 0.04 cc/min, the atomizing pressure was 0.05 Mpa, and the spray gun reciprocated once at 5 mm/sec in the longitudinal direction of the cleaning blade.

Next, the coating liquid 5 was sprayed on an under surface 62*b* of the blade in FIG. 6 to form a surface layer 623 thereon as well. From a place 4 mm far from the tip ridgeline 62*c* of the urethane rubber to the holder 621 was masked with a PET film having a thickness of 100 μm using stickiness of the rubber to be uncoated. The spray gun was fixed such that the tip thereof had the same height of the tip ridgeline 62*c*, the cleaning blade was horizontal in the longitudinal direction and the under surface 62*b* of the blade was vertical. A distance from the tip of the pray gun to the polyurethane rubber was 60 mm. The coating liquid discharge speed was 0.06 cc/min, the atomizing pressure was 0.05 Mpa, and the spray gun reciprocated 1.5 times at 5 mm/sec in the longitudinal direction of the cleaning blade. Then, the cleaning blade was dried to touch for 3 min, and irradiated with UV light and dried as the cleaning blade 1 was to obtain a [cleaning blade 6].

Example 7

Preparation of Cleaning Blade 7

The procedure for preparation of the cleaning blade 2 in Example 2 was repeated to prepare a [cleaning blade 7] except for replacing the coating liquid 2 with the coating liquid 5.

Example 8

Preparation of Cleaning Blade 8

The procedure for preparation of the cleaning blade 3 in Example 3 was repeated to prepare a [cleaning blade 8] except for replacing the coating liquid 1 with the coating liquid 5.

Example 9

Preparation of Cleaning Blade 9

The procedure for preparation of the cleaning blade 4 in Example 4 was repeated to prepare a [cleaning blade 9] except for replacing the coating liquid 2 with the coating liquid 5.

Example 10

Preparation of Cleaning Blade 10

The procedure for preparation of the cleaning blade 5 in Example 5 was repeated to prepare a [cleaning blade 10] except for replacing the coating liquid 2 with the coating liquid 5.

Example 11

Preparation of Cleaning Blade 11

The procedure for preparation of the cleaning blade 6 in Example 6 was repeated to prepare a [cleaning blade 11] except that the polyurethane rubber was fixed on the holder 621 formed of a metal plate with an adhesive so as to have the projected length L of 4 mm from the holder 62, and a place 2 mm from the tip ridgeline 62*c* of the urethane rubber to the holder 621 was dipped.

Example 12

Preparation of Cleaning Blade 12

The procedure for preparation of the cleaning blade 10 in Example 10 was repeated to prepare a [cleaning blade 12] except that the polyurethane rubber was fixed on the holder 621 formed of a metal plate with an adhesive so as to have the projected length L of 4 mm from the holder 62, and a place 2 mm from the tip ridgeline 62*c* of the urethane rubber to the holder 621 was dipped.

Example 13

Preparation of Cleaning Blade 13

The procedure for preparation of the cleaning blade 12 in Example 12 was repeated to prepare a [cleaning blade 13] except that a place 3 mm from the tip ridgeline 62*c* of the urethane rubber to the holder 621 was dipped.

Comparative Example 1

Preparation of Cleaning Blade 14

The procedure for preparation of the cleaning blade 1 in Example 1 was repeated to prepare a [cleaning blade 14] except for replacing the high-pressure mercury lamp with a metal halide lamp with a light source having an intensity peak at a wavelength of 450 μm in a wavelength range of from 200 to 500 μm to irradiate UV light to the blade.

Comparative Example 2

Preparation of Cleaning Blade 15

The procedure for preparation of the cleaning blade 1 in Example 1 was repeated to prepare a [cleaning blade 15] except for dipping the ridgeline in the coating liquid 1 for 10 min instead of 60 sec.

Comparative Example 3

Preparation of Cleaning Blade 16

The procedure for preparation of the cleaning blade 14 in Comparative Example 1 was repeated to prepare a [cleaning blade 16] except for replacing the coating liquid 1 with the coating liquid 3 and dipping the ridgeline in the coating liquid 1 for 10 min instead of 60 sec.

Comparative Example 4

Preparation of Cleaning Blade 17

The procedure for preparation of the cleaning blade 16 in Comparative Example 3 was repeated to prepare a [cleaning blade 17] except for replacing the coating liquid 3 with the coating liquid 4.

Comparative Example 5

Preparation of Cleaning Blade 18

The procedure for preparation of the cleaning blade 17 in Comparative Example 4 was repeated to prepare a [cleaning blade 18] except for dipping the ridgeline in the coating liquid 1 for 1 sec instead of 10 min.

Comparative Example 6

Preparation of Cleaning Blade 19

The procedure for preparation of the cleaning blade 14 in Comparative Example 1 was repeated to prepare a [cleaning blade 19] except for replacing the coating liquid 1 with the coating liquid 5.

Comparative Example 7

Preparation of Cleaning Blade 20

The procedure for preparation of the cleaning blade 15 in Comparative Example 2 was repeated to prepare a [cleaning blade 20] except for replacing the coating liquid 1 with the coating liquid 5.

Comparative Example 8

Preparation of Cleaning Blade 21

The procedure for preparation of the cleaning blade 16 in Comparative Example 3 was repeated to prepare a [cleaning blade 21] except for replacing the coating liquid 3 with the coating liquid 5.

Comparative Example 9

Preparation of Cleaning Blade 22

The procedure for preparation of the cleaning blade 17 in Comparative Example 4 was repeated to prepare a [cleaning blade 22] except for replacing the coating liquid 4 with the coating liquid 5.

Comparative Example 10

Preparation of Cleaning Blade 23

The procedure for preparation of the cleaning blade 18 in Comparative Example 5 was repeated to prepare a [cleaning blade 23] except for replacing the coating liquid 4 with the coating liquid 5.

Figure 7:
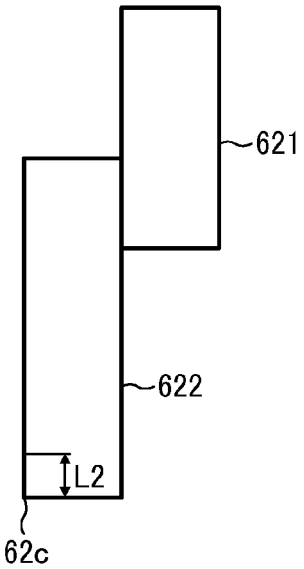
FIG. 7 is a schematic view illustrating a position of the cleaning blade, the Martens hardness of which is measured.

Each of the cleaning blades 1 to 23 was cut in round slices to reveal the cross section, and Martens hardness of the insides of 20, 30 and 40 μm from the surface on a measurement line as shown in FIG. 7 were measured. The results are shown in Table 1. L2 in FIG. 7 is a distance from a ridgeline of the measurement line. Inside hardness 1 was measured at a point of L2=1 mm of each of the cleaning blades 1 to 23. Inside hardness 2 was measured at a point of L2=3 mm of each of the cleaning blades 11 to 13 and at a point of L2=5 mm of each of the other blades.

Marten's hardness was measured by a microscopic hardness meter HM-2000 from Fischer Instruments, the Vickers indenter of which was pushed into an object at 1.0 mN for 10 sec, held for 5 sec, and drawn at 1.0 mN for 10 sec.

TABLE 1

| | | Inside Hardness 1 (L2 = 1 mm) [N/mm$^2$] | | | Inside Hardness 2 (L2 = 5 mm or 3 mm) [N/mm$^2$] | | |
|---|---|---|---|---|---|---|---|
| | | 20 μm | 30 μm | 40 μm | 20 μm | 30 μm | 40 μm |
| Example 1 | Cleaning Blade 1 | 2.1 | 1.1 | 0.7 | 0.8 | 0.7 | 0.7 |
| Example 2 | Cleaning Blade 2 | 2.5 | 0.8 | 0.7 | 0.8 | 0.8 | 0.8 |
| Example 3 | Cleaning Blade 3 | 4.8 | 2.0 | 0.8 | 0.7 | 0.7 | 0.7 |
| Example 4 | Cleaning Blade 4 | 5.0 | 0.8 | 0.8 | 0.8 | 0.8 | 0.8 |
| Example 5 | Cleaning Blade 5 | 0.9 | 0.3 | 0.3 | 0.4 | 0.3 | 0.3 |
| Example 6 | Cleaning Blade 6 | 2.2 | 1.2 | 0.8 | 0.8 | 0.8 | 0.8 |
| Example 7 | Cleaning Blade 7 | 2.8 | 0.8 | 0.8 | 0.8 | 0.8 | 0.7 |
| Example 8 | Cleaning Blade 8 | 4.9 | 1.9 | 0.6 | 0.7 | 0.7 | 0.7 |
| Example 9 | Cleaning Blade 9 | 5.0 | 0.8 | 0.6 | 0.7 | 0.8 | 0.7 |
| Example 10 | Cleaning Blade 10 | 1.2 | 0.4 | 0.3 | 0.4 | 0.4 | 0.4 |
| Example 11 | Cleaning Blade 11 | 2.2 | 1.2 | 0.8 | 0.7 | 0.7 | 0.6 |
| Example 12 | Cleaning Blade 12 | 1.3 | 0.4 | 0.3 | 0.3 | 0.3 | 0.3 |
| Example 13 | Cleaning Blade 13 | 1.3 | 0.4 | 0.3 | 1.2 | 0.4 | 0.4 |
| Comparative Example 1 | Cleaning Blade 14 | 2.1 | 1.0 | 0.9 | 0.8 | 0.8 | 0.7 |
| Comparative Example 2 | Cleaning Blade 15 | 6.1 | 0.8 | 0.7 | 0.7 | 0.7 | 0.6 |
| Comparative Example 3 | Cleaning Blade 16 | 5.8 | 5.5 | 5.2 | 0.7 | 0.7 | 0.7 |
| Comparative Example 4 | Cleaning Blade 17 | 5.3 | 4.6 | 3.8 | 0.8 | 0.8 | 0.8 |
| Comparative Example 5 | Cleaning Blade 18 | 0.8 | 0.7 | 0.7 | 0.7 | 0.7 | 0.7 |
| Comparative Example 6 | Cleaning Blade 19 | 2.5 | 0.9 | 0.9 | 0.7 | 0.7 | 0.7 |
| Comparative Example 7 | Cleaning Blade 20 | 7.2 | 0.7 | 0.7 | 0.7 | 0.7 | 0.6 |
| Comparative Example 8 | Cleaning Blade 21 | 6.2 | 5.7 | 5.5 | 0.6 | 0.6 | 0.6 |
| Comparative Example 9 | Cleaning Blade 22 | 5.9 | 4.5 | 3.9 | 0.7 | 0.6 | 0.6 |
| Comparative Example 10 | Cleaning Blade 23 | 0.9 | 0.6 | 0.6 | 0.6 | 0.6 | 0.6 |

Next, each of the cleaning blades 1 to 23 was installed in modified Ricoh Pro C751 which is the same apparatus in FIG. 2. A part of the photoreceptor was replaced with an internally produced pressure measurer (weight measurer), and the cleaning blade was set to contact the measurer as it contacts the photoreceptor. A contact pressure (weight per unit length) measured by the measurer was 25 g/cm. When the cleaning blade contacted the photoreceptor, an angle between a tangent passing a contact point on the circumference of the photoreceptor and the surface of 62*a* was 80°. A spherical toner was used.

After 50,000 images and 100,000 images were produced at a rotational linear speed of 600 mm/sec of the photoreceptor, whether a toner scraped off from a gap between the blade and the photoreceptor is present on the image or the photoreceptor was visually observed.

Good: Toner was not visually observed on an image nor on the photoreceptor

Fair: No toner was not visually observed on an image but toner was visually observed on the photoreceptor Poor: Toner was visually observed on both of an image and the photoreceptor The results are shown in Table 2.

TABLE 2

| | | Evaluation Result | |
|---|---|---|---|
| | Cleaning Blade No. | After 50,000 images were produced | After 50,000 images were produced |
| Example 1 | Cleaning Blade 1 | Good | Fair |
| Example 2 | Cleaning Blade 2 | Good | Good |
| Example 3 | Cleaning Blade 3 | Good | Fair |
| Example 4 | Cleaning Blade 4 | Good | Good |
| Example 5 | Cleaning Blade 5 | Good | Good |
| Example 6 | Cleaning Blade 6 | Good | Fair |
| Example 7 | Cleaning Blade 7 | Good | Good |
| Example 8 | Cleaning Blade 8 | Good | Fair |
| Example 9 | Cleaning Blade 9 | Good | Good |
| Example 10 | Cleaning Blade 10 | Good | Good |
| Example 11 | Cleaning Blade 11 | Good | Fair |
| Example 12 | Cleaning Blade 12 | Good | Good |
| Example 13 | Cleaning Blade 13 | Good | Good |
| Comparative Example 1 | Cleaning Blade 14 | Poor | Poor |
| Comparative Example 2 | Cleaning Blade 15 | Poor | Poor |
| Comparative Example 3 | Cleaning Blade 16 | Poor | Poor |
| Comparative Example 4 | Cleaning Blade 17 | Poor | Poor |
| Comparative Example 5 | Cleaning Blade 18 | Poor | Poor |
| Comparative Example 6 | Cleaning Blade 19 | Poor | Poor |
| Comparative Example 7 | Cleaning Blade 20 | Poor | Poor |
| Comparative Example 8 | Cleaning Blade 21 | Poor | Poor |
| Comparative Example 9 | Cleaning Blade 22 | Poor | Poor |
| Comparative Example 10 | Cleaning Blade 23 | Poor | Poor |

Having now fully described the invention, it will be apparent to one of ordinary skill in the art that many changes and modifications can be made thereto without departing from the spirit and scope of the invention as set forth therein.

What is claimed is:

1. A cleaning blade cleaning the surface of an object, comprising:

a rigid holder; and a strip-shaped elastic body fixed on the holder, comprising a tip ridgeline configured to contact the surface of the object, wherein the cleaning blade comprises a part having a Martens hardness of from 0.9 to 5.0 N/mm$^2$ at a depth of 20 μm from an undersurface of the blade including the ridgeline, 0.3 to 0.8 N/mm$^2$ at a depth of 40 μm therefrom, and the Martens hardness at a depth of 20 μm therefrom larger than that at a depth of 40 μm therefrom by 0.6 N/mm$^2$.

2. The cleaning blade of claim 1, wherein the part having a Martens hardness of from 0.9 to 5.0 N/mm$^2$ at a depth of 20 μm from an undersurface of the blade including the ridgeline, 0.3 to 0.8 N/mm$^2$ at a depth of 40 μm therefrom, and the Martens hardness at a depth of 20 μm therefrom larger than that at a depth of 40 μm therefrom by 0.6 N/mm$^2$ further has a Martens hardness of 0.3 to 0.8 N/mm$^2$ at a depth of 30 μm therefrom.

3. The cleaning blade of claim 1, wherein the elastic body comprises a projection having a length L not less than 4 mm from the holder, and the cleaning blade comprises a part having a Martens hardness of from 0.9 to 5.0 N/mm$^2$ at a depth of 20 μm from an undersurface of the blade including the ridgeline, 0.3 to 0.8 N/mm$^2$ at a depth of 40 μm therefrom, and the Martens hardness at a depth of 20 μm therefrom larger than that at a depth of 40 μm therefrom by 0.6 N/mm$^2$ on the surface from the tip ridgeline to a length of L/2.

4. The cleaning blade of claim 1, wherein the elastic body comprises a polyurethane rubber and an acrylic curing resin.

5. The cleaning blade of claim 1, wherein the elastic body comprises an impregnated part with an acrylic curing resin.

6. The cleaning blade of claim 5, wherein the impregnated part comprises an acrylic curing resin film on the surface.

7. The cleaning blade of claim 4, wherein the acrylic curing resin is cured by UV irradiation.

8. An image forming apparatus, comprising:

an image bearer;

a transferer configured to transfer an image formed on the image bearer onto a recording medium; and a cleaning member configured to contact the surface of the image bearer to remove adherents adhering thereto, wherein the cleaning member is the cleaning blade according to claim 1.

9. A process cartridge detachable from image forming apparatus, comprising:

an image bearer;

a transferer configured to transfer an image formed on the image bearer onto a recording medium; and a cleaning member configured to contact the surface of the image bearer to remove adherents adhering thereto, wherein the cleaning member is the cleaning blade according to claim 1.

* * * * *